US005102128A

United States Patent [19]

Geise

[11] Patent Number: 5,102,128

[45] Date of Patent: Apr. 7, 1992

[54] PORTABLE BASKETBALL GOAL

[76] Inventor: Lawrence R. Geise, 3790 Spur La., Columbus, Ohio 43221

[21] Appl. No.: 774,630

[22] Filed: Oct. 10, 1991

[51] Int. Cl.[5] ..... A63B 6/08

[52] U.S. Cl. ..... 273/1.5 R

[58] Field of Search ..... 273/1.5 RA

[56] References Cited

U.S. PATENT DOCUMENTS

| | | | |
|---|---|---|---|
| 3,329,427 | 7/1967 | Bearson | 273/1.5 R |
| 4,526,367 | 7/1985 | Haston et al. | 273/1.5 R |
| 4,869,501 | 9/1989 | Anastasakis | 273/1.5 R |
| 4,941,661 | 7/1990 | Lykens | 273/1.5 R |
| 4,951,944 | 8/1990 | Morgan | 273/1.5 R |

FOREIGN PATENT DOCUMENTS

| | | | |
|---|---|---|---|
| 632409 | 10/1963 | Belgium | 273/1.5 R |
| 665898 | 10/1965 | Belgium | 273/1.5 R |
| 2234942 | 12/1978 | Fed. Rep. of Germany | 273/1.5 R |
| 2920903 | 12/1980 | Fed. Rep. of Germany | 273/1.5 R |
| 306083 | 6/1955 | Switzerland | 273/1.5 R |
| 520656 | 4/1940 | United Kingdom | 273/1.5 R |

OTHER PUBLICATIONS

Washington Post, Mar. 4, 1987, p. C7, Tank McNamara.

*Primary Examiner*—Paul E. Shapiro

*Attorney, Agent, or Firm*—Thomas S. Baker, Jr.

[57] ABSTRACT

A portable basketball goal has a frame assembly which may be extended and retracted, a mast which may be raised and lowered and a support arm which may be raised and lowered.

5 Claims, 2 Drawing Sheets

PORTABLE BASKETBALL GOAL

BACKGROUND OF THE INVENTION

Traditionally, basketball goals utilized at a residence have a backboard with a goal basket rigidly mounted on a fixed metal pole or on a metal structure attached to some part of the residence. In most instances the fixed pole or the portion of the residence which supports the basketball goal lies adjacent a driveway or similar hard surface which may be utilized as a basketball playing surface. Such fixed basketball goals at residences generally detract from the aesthetics of the residence and basketballs being thrown toward the goal inadvertently may strike parts of the residence such as a garage door or a window and cause damage thereof. Additionally, a solid pole which mounts a basketball goal may make ingress and egress of a driveway more difficult inasmuch as the pole must be located close to the driveway surface if it is to be used as a basketball playing surface.

Thus, it becomes desirable to provide a portable basketball goal for residential use which may be moved to a driveway or other playing surface when a participant wants to play basketball and may be removed from the playing surface thereafter. Ideally, the portable basketball goal should be collapsible in height and lengthwise to occupy the smallest possible space when not in use.

A mechanism for raising and lowering a basketball backboard with respect to a fixed surface and having a parallelogram mechanism is shown in U.S. Pat. No. 2,881,003 (Drew). A portable adjustable basketball goal in which the backboard and goal basket may be adjusted in height with respect to a base with the base including a wheel assembly for moving the goal may be seen in U.S. Pat. No. 3,025,058 (Brumfield). Another type of adjustable and movable basketball goal is shown in U.S. Pat. No. 3,427,025 to Proctor. This patent discloses a vertically adjustable basketball goal having wheels to make it portable. U.S. Pat. No. 3,722,886 (Sinner) discloses a wheeled stand for a basketball goal which allows the height of the goal to be adjusted vertically. This device may be secured to a motor vehicle or bolted to a solid surface to secure it in place. German Publication DT2234942 discloses a basketball goal having a height adjustable backboard and goal basket and a parallelogram linkage which enables the device to be collapsed to the ground. A nonportable vertically adjustable basketball goal may be seen in U.S. Pat. No. 4,801,142 (Friesen). This device would not be portable. A portable basketball goal which is collapsible is disclosed in U.S. Pat. No. 4,869,501 to Anastasakis.

One disadvantage of prior portable basketball goals resides in the fact that those that are collapsible either have a vertical support located directly below the backboard which support may cause injury to a player or the units have a long horizontally extending base which receives a counterweight and the backstop and goal basket are mounted on an angled support member which extends outwardly from the base to eliminate the problems associated with a support directly beneath a goal. The long extended base makes storage of the portable goal difficult.

Accordingly, it becomes desirable to provide a portable basketball goal having a vertically adjustable backboard and goal basket, which provides a support mechanism for the backboard and goal basket which does not extend directly below the backboard and having a base adapted to receive a counterweight which may be extended and retracted to enable the device to be reduced in size for storage.

SUMMARY OF THE INVENTION

The instant invention provides a portable basketball goal with a horizontally extending lower frame assembly having a base with a front end and a rear end and a movable base extension which may be extended from and retracted into the rear end of said base. A mast pivotally attaches to the lower frame assembly at the front end thereof and pivots between a storage position in which it extends parallel to the lower frame and a use position in which it extends perpendicular to the lower frame assembly. A support arm having an outer end and an inner end slideably mounts on the mast at its inner end and projects outwardly from the front end thereof at an angle. The arm is movable between a raised position and a lowered position. A backboard and goal basket are mounted on the outer end of the arm.

DESCRIPTION OF THE PREFERRED EMBODIMENT

Figure 1:
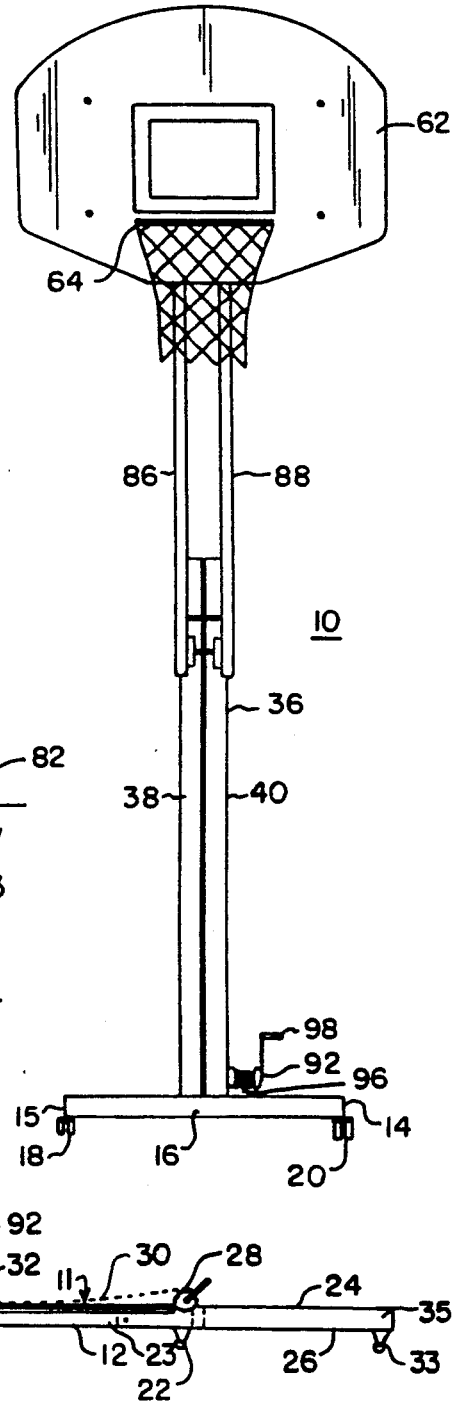
FIG. 1 is a front view of the portable basketball goal of the present invention.
Figure 2:
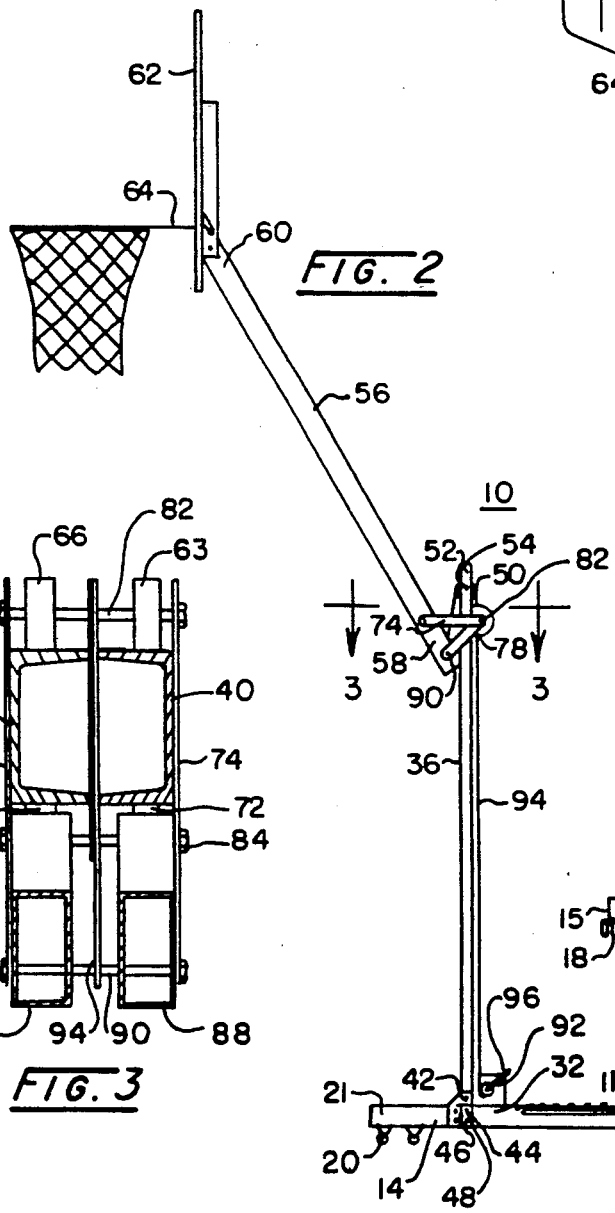
FIG. 2 is a side view of the portable basketball goal.

The portable basketball goal assembly (10) of the present invention may be seen in the in playing position by referring to FIGS. 1 and 2. The basketball goal assembly (10) has a generally rectangular, horizontally extending, lower frame assembly (11) having a base (12) and an extensible and retractable base extension (24). Base (12) includes a pair of parallel longitudinally extending side box members (14) and (15) and a laterally extending front box member (16) which joins the side box members (14 and 15). Additional lateral box members may be incorporated to join the longitudinal box members (14 and 15) to increase the rigidity of the structure. Two sets of wheels (18 and 20) are mounted at either end of the front box member (16) to support the front end (21) of the base (12) and two sets of wheels (21 and 22) and are attached to the side box members (14 and 15) to support the rear end (23) of the base (12). The wheel assemblies (18 through 22) enable the portable basketball goal assembly (10) to be moved easily.

The extensible and retractable base extension (24) has a pair of longitudinally extending side rails (26 and 27) which are channel shaped and which are adapted to overlie and telescope with respect to the side box members (14 and 15). The side rails (26 and 27) are connected by one or more laterally extending members. Thus, the base extension (24) may be extended or retracted longitudinally with respect to the fixed base (12). Base extension (24) functions to receive a counterweight and to provide a longer moment arm to counterbalance the weight of the backboard and goal basket to be described hereinbelow. Frame extension (24) mounts a winch (28) having a cable (30) the outer end of which is attached to the horizontally extending base (12) at (32). Winch (28) acts to retract the base extension (24) within base (12).

The base extension (24) mounts a set of wheels (33 and 34) at its outer end (35) to provide additional stability for the basketball goal assembly (10) when the frame extension (24) has been telescoped outwardly from the horizontally extending base (12).

Figure 5:
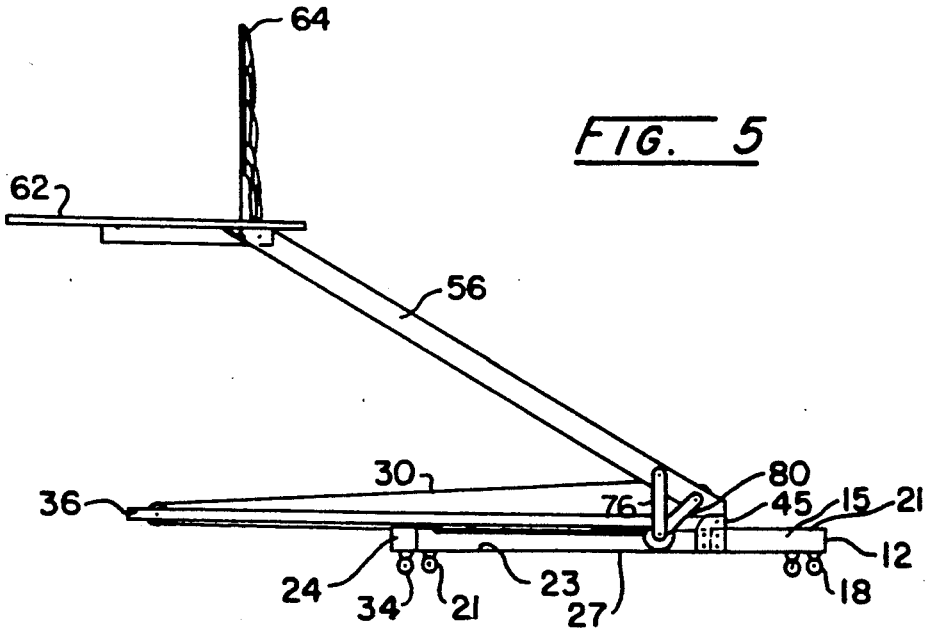
FIG. 5 is a view showing the mast for the backboard in a retracted position.

Base (12) pivotally mounts a mast (36) at the front end (21) thereof. Mast (36) is formed from a pair of C-shaped channels (38 and 40) which are joined together at their outer ends to form a rectangular box as may be seen best by referring to FIGS. 2 and 3. Mast (36) pivots about a shaft (42) secured in a pair of flanges (44) and (45) mounted on base (12). Flanges (44 and 45) have a pair of aligned bores (46) which are on either side of a bore, not shown, in mast (36). When mast (36) has been raised to assume a position in which it extends perpendicular to base (12) as illustrated in FIG. 2, the bore in mast (36) is aligned with the bores (46) formed in the flanges (44 and 45). A pin (48) may be inserted in the aligned bores (46) and pass through the bore in mast (36) to maintain the mast (36) in the vertical position. Pin (48) may be withdrawn from the aligned bores (46) and the bore in the mast (36) to enable the mast (36) to be pivoted to a horizontal position in which it extends parallel to the base extension (24) as depicted in FIG. 5. Looking to FIG. 2, it may be observed that a pulley (50) is mounted on a shaft (52) which extends between the channels (38 and 40) at the outer end (54) of mast (36). Pulley (50) functions to guide a cable as will be described hereinbelow.

Turning to FIGS. 1 and 2, it may be observed that an arm (56) is slideably mounted at its inner end (58) on mast (36). Arm (56) is mounted at an angle on mast (36) such that its outer end (60) projects outwardly from base (12) opposite from the direction of base extension (24). With this construction, a backboard (62) having a goal basket (64) mounted at the outer end (60) of arm (56) is located outwardly of base (12) and base extension (24) such that the area vertically beneath the goal basket (64) is not infringed by other parts of the basketball goal assembly (10).

Figure 3:
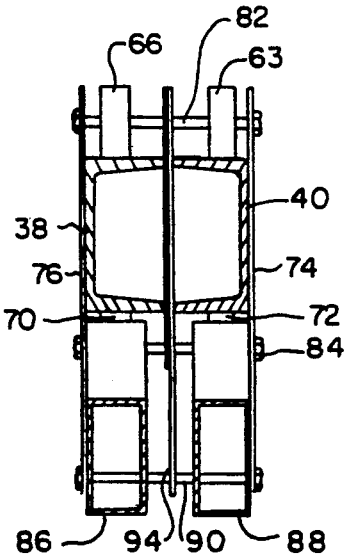
FIG. 3 is a view along line 3—3 of FIG. 2.

Arm (56) mounts slideably on mast (36) by means of two pairs of rollers (66 through 72) best shown in FIG. 3. The rollers (66 through 72) are affixed to the inner end (58) of arm (56) by an upper pair of parallel arms (74 and 76) and a lower pair of parallel arms (78 and 80). Rollers (66 and 68) are mounted on a shaft (82) which is secured to the intersection of both pairs of arms as may be seen by referring to FIGS. 2 and 3. Rollers (70 and 72) are mounted on a shaft (84) secured to the inner end (58) of arm (56). The upper pair of arms (74 and 76) which mount shaft (82) and rollers (66 and 68) also are affixed to the inner end (58) of arm (56). The lower pair of arms (78 and 80) which serve to mount shaft (84) are affixed to the inner end (58) of arm (56) beneath the attachment point for the arms (74 and 76). A pin (90) connects the outer ends of arms (74 and 76) to arm (56). With this construction, the rollers (66 and 68) engage the side of mast (36) facing base extension (24) whereas the rollers (70 and 72) engage the side of mast (36) facing the front end (21) of base (12). The rollers (66 through 72) serve to resist the clockwise torque imposed on mast (36) by arm (56), backboard (62) and goal basket (64).

As mentioned above, arm (56) is slideably attached to mast (36) at an angle. The angular position of arm (56) with respect to mast (36) may be changed or adjusted by altering the length of the arms (74 through 80) which mount the arm (56) and rollers (66 through 72) on mast (36).

As discussed previously, arm (56) may be formed from a pair of spaced parallel channel members (86 and 88). Alternatively, arm (56) may be formed from a single box or channel member. Base (12) mounts a winch (92) adjacent but offset to one side of mast (36). A cable (94) extends from winch (92) upwardly along mast (36) over pulley (50) mounted at the outer end of mast (36) and has one end attached to pin (90) at the inner end (58) of arm (56). The opposite end of cable (94) attaches to a drum (96) on winch (92). A handle (98) attaches to drum (96). Rotation of handle (98) enables the arm (56) to be adjusted to any desired playing height between the fully raised and the fully retracted positions.

FIGS. 1 and 2 depict the portable basketball goal assembly (10) of the present invention set up in a playing position. Base extension (24) has been moved outwardly from the rear end (23) of base (I2) to increase the stability of the device and to counterbalance the weight of the backboard (62) and the goal basket (64). Preferably, a counterweight such as a rock or a container of water would be placed upon base extension (24) to assist in counterbalancing the weight of backboard (62) and goal basket (64). Additionally, mast (36) has been moved from a horizontal position as illustrated in FIG. 5 to the vertical position illustrated in FIGS. 1, 2 and 4. When mast (36) assumes this position, a pin (48) is inserted in parallel aligned bores (46) to maintain the mast (36) in the upright position. Lastly, winch (92) is operated by rotation of handle (96) to raise arm (56) to the top of mast (36). Again, turning to FIG. 2, it may be observed that the playing area vertically beneath the goal basket (64) lies outboard of base (12) and base extension (24) to provide an unobstructed playing area directly beneath goal basket (64).

Figure 4:
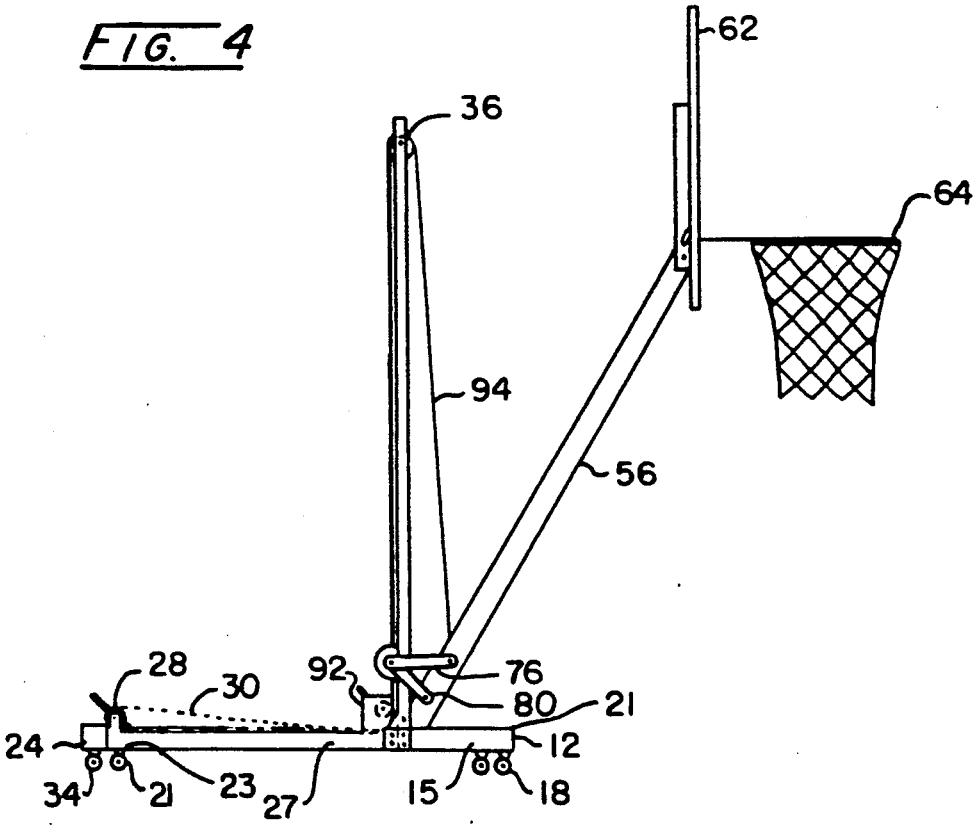
FIG. 4 is a view similar to FIG. 2 showing the mast for the backboard and goal basket lowered to a retracted position.

Collapsing the portable basketball goal assembly (10) of the present invention to a storage position will be described in connection with FIGS. 4 and 5. Initially, winch (92) must be operated to lower arm (56) to the bottom of mast (36). The weight of arm (56), backboard (62) and goal basket (64) cause this assembly to move downwardly along mast (36) when the cable locking mechanism in winch (92) has been released.

Subsequent to the lowering of arm (56) to the bottom of mast (36), the pin (48) is withdrawn from bores (46) and mast (36) is moved to the horizontal position depicted in FIG. 5. Lastly, winch (28) is operated to retract base extension (24) into base (12). FIG. 5 depicts the portable basketball goal assembly (10) of the present invention collapsed to its minimum size and ready for storage. Again, as described above, adjusting the portable basketball goal assembly (10) of the present invention from the storage position depicted in FIG. 5 to the playing position depicted in FIGS. 1 and 2 simply requires a person to repeat the steps required for collapsing the structure in inverse order.

Since certain changes may be made to the above-described apparatus, system and method without departing from the scope of the invention herein, it is intended that all matter contained in the description thereof or shown in the accompanying drawings shall be interpreted as illustrative and not in a limiting sense.

We claim:

1. A portable basketball goal which comprises:

a horizontally extending lower frame assembly having a base with a front end and a rear end and a movable base extension which may be extended from and retracted into the rear end of said base;

a mast pivotally attached to said base at the front end thereof and pivotable between a storage position in which it extends parallel to said lower frame assembly base and a use position in which it extends perpendicular to said lower frame assembly;

an arm having an outer end and an inner end slideably mounted on said mast at its inner end and which projects outwardly from said front end at an angle and which is movable on said mast between an extended position and a retracted position;

a backboard and goal basket mounted on the outer end of said arm; and wherein said arm mounts on said mast at an angle such that the backboard and goal basket project outwardly and away from said base.

2. The basketball goal of claim 1 further comprising:

a roller assembly affixed to the inner end of said second mast and wherein said roller assembly has a first roller set which engages one side of said arm and a second roller set which engages another side of said arm.

3. The basketball goal of claim 1 further comprising:

a winch means mounted on said base for moving said arm between said extended position and said retracted position.

4. The basketball goal of claim 3 in which said winch means may be operated to position and set said arm at any desired height between said extended position and said retracted position.

5. The basketball goal of claim 1 further comprising:

a second winch means mounted on said base extension to move said base extension between said extended position and said retracted position.

* * * * *